US005611626A

United States Patent [19]

Warr

[11] Patent Number: 5,611,626

[45] Date of Patent: *Mar. 18, 1997

[54] BAG WITH REENFORCED HANDLE AND RESEALABLE POUR SPOUT OPENING

[75] Inventor: Charles J. Warr, High Point, N.C.

[73] Assignee: Rex-Rosenlew International Incorporated, Thomasville, N.C.

[ * ] Notice: The term of this patent shall not extend beyond the expiration date of Pat. No. 5,558,438.

[21] Appl. No.: 621,575

[22] Filed: Mar. 26, 1996

Related U.S. Application Data

[63] Continuation of Ser. No. 509,831, Aug. 1, 1995, Pat. No. 5,558,438, which is a continuation-in-part of Ser. No. 500, 173, Jul. 10, 1995.

[51] Int. Cl.[6] ..... B65D 33/08; B65D 33/20

[52] U.S. Cl. ..... 383/10; 383/17; 383/62; 383/81; 383/209; 383/906

[58] Field of Search ..... 383/9, 10, 17, 383/62, 78, 81, 207, 209, 906

[56] References Cited

U.S. PATENT DOCUMENTS

| | | | |
|---|---|---|---|
| 2,182,261 | 12/1939 | Maas | 383/10 |
| 2,394,335 | 2/1946 | Shapiro | 383/78 X |
| 4,633,508 | 12/1986 | Sanders | 383/62 X |
| 4,696,050 | 9/1987 | Sengewald | 383/10 |
| 4,790,670 | 12/1988 | Barbaro | 383/62 |
| 5,338,117 | 8/1994 | Kucksdorf et al. | 383/10 X |
| 5,482,376 | 1/1996 | Moseley et al. | 383/209 |

FOREIGN PATENT DOCUMENTS

| | | | |
|---|---|---|---|
| 2849425 | 5/1979 | Germany | 383/62 |
| 9011946 | 10/1990 | WIPO | 383/81 |

OTHER PUBLICATIONS

Ralston Purina Company, Butcher's Blend brand Dog Food, Feb. 12, 1995, St. Louis, MO.

*Primary Examiner*—Jes F. Pascua
*Attorney, Agent, or Firm*—W. Thad Adams, III, P.A.

[57] ABSTRACT

A bag with a corner tear-away pour spout opening is provided with a detachable reenforcing patch adhered to the area of a slit near the top of the bag which serves as a carry handle to provide enhanced strength to the handle area. The patch can be removed from its position over the handle slit and used to reseal the bag for storage after some of the contents have been dispensed through the pour spout opening.

8 Claims, 6 Drawing Sheets

BAG WITH REENFORCED HANDLE AND RESEALABLE POUR SPOUT OPENING

This application is a continuation of application Ser. No. 08/509,831, filed on Aug. 1, 1995, now U.S. Pat. No. 5,558,438, which is a continuation-in-part of application Ser. No. 08/500,173, filed on Jul. 10, 1995.

This invention relates to a bag with a reenforced handle and a resealable pour spout opening. The same patch of material which serves to reenforce the handle when the bag is being carried can be removed from the area of the handle and replaced over the opening from which contents were poured from the bag. While the invention has particular application to bags with a capacity of from 10 to 40 pounds, the principle of the invention is applicable to bags of any size.

Bags of the type disclosed in this application with reference to the invention are heavy-duty bags made from multi-ply high strength polyolefins, such as LDPE polyethylene, as well as other woven or nonwoven, synthetic or non-synthetic web materials. Such bags are typically used to package materials such as salt, potting soil, small landscaping rocks, pet food and similar heavy materials.

Such bags with tear-away pour spouts, including applicant's own bag construction disclosed in this application's parent, heretofore have not been easily resealable. In cases where the entire contents of the bag are emptied, of course, the bag is merely discarded.

In instances where only part of the contents is emptied, and the bag must be resealed, the bag can be resealed with clips or with tape, but such items are normally not readily available. Thus, the contents are subject to spillage or spoilage due to the open pour spout which is typically left open.

SUMMARY OF THE INVENTION

Therefore, it is an object of the invention to provide a readily available length of tape which can be used to close the pour spout of a bag when contents remain in the bag for storage after initial opening.

It is another object of the invention to provide a length of tape for closing the pour spout of a bag which also provides reenforcement to the bag until the tape is needed for closing the pour spout.

It is another object of the invention to provide a length of tape for closing the pour spout of a bag which is carried on the bag until needed for closing the pour spout, and which is easily removable without damage to the bag, when needed.

These and other objects of the present invention are achieved in the preferred embodiments disclosed below by providing a bag including first and second walls having joined first and second opposed side edges, an end edge, at least one seal line spaced from the end edge and extending laterally from one side to the other for sealing closed the end of the bag and a die cut opening defining a handle in the first and second walls adjacent the end edge for receiving a hand therethrough. A plurality of spaced-apart perforations in both side walls extend in a line from the end edge diagonally to one of the first or second side edges and form a tear line for permitting a corner portion of the first and second walls, including a portion of the end edge of the bag, to be torn away from the bag in a progressive tearing motion to form a pour spout opening in the bag from which the contents of the bag can be poured. In combination with the bag, a handle reenforcement and resealing means is provided and includes a patch of sheet material secured by a pressure sensitive adhesive to at least one of the first or second walls of the bag and positioned in reenforcing relation to the die cut handle for providing reinforcement to the handle when the bag is being carried by the handle. The patch is removable from its reenforcing position on the handle and repositioned over the pour spout opening in the bag and secured in place by the pressure sensitive adhesive for sealing the pour spout opening in the bag to retain remaining contents therein.

According to one preferred embodiment of the invention, the sheet material is formed of a sheet of thermoplastic material.

According to another preferred embodiment of the invention, the thermoplastic material is selected from the group consisting of polyolefin, polypropylene and polystyrene.

According to yet another preferred embodiment of the invention, the thermoplastic material comprises high strength polyethylene film.

According to yet another preferred embodiment of the invention, the sheet material is secured to one wall of the bag.

According to yet another preferred embodiment of the invention, the sheet material comprises first and second reenforcement patches secured to respective first and second walls of the bag.

According to yet another preferred embodiment of the invention, the sheet material is die cut in registration with the die cut handle, and is positioned over and in surrounding relation to the die cut handle.

According to yet another preferred embodiment of the invention, the bag includes two spaced-apart seal lines adjacent the end edge of the bag, the handle being positioned in an area between the two spaced-apart seal lines.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
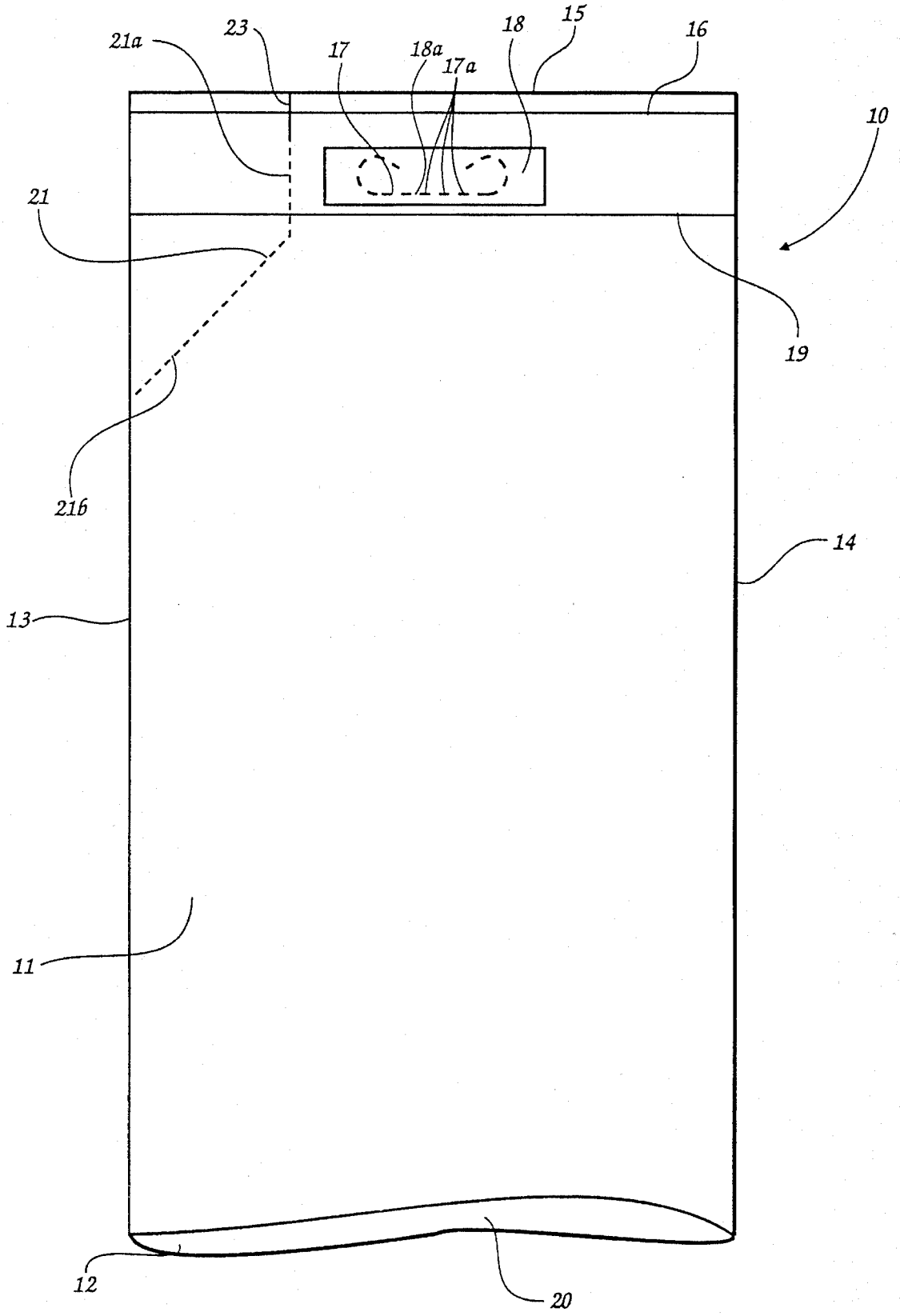
FIG. 1 is a simplified side view of a bag according to an embodiment of the invention.

Referring now specifically to the drawings, a bag with a reenforced handle and a resealable pour spout opening according to the present invention is illustrated in FIG. 1 and shown generally at reference numeral 10.

Bag 10 is formed from thermoplastic sheet stock, and has overlying walls 11 and 12, defining opposed, joined side edges 13 and 14. The term "joined" as used herein is used in its broad sense to mean either two formerly separate sheets connected together, or integrally formed by, for example, folding over a sheet to define an edge.

For purposes of example and illustration, bag 10 is a flat tube-type bag. However, bags incorporating the invention of this application may be fabricated in a side-gusset style tube style, flat tube back-seamed style, side gusset back seam style or any other suitable bag design. The top end edge 15 of the bag is closed by a an elongate seal 16 formed by adhesive, ultrasonic heating or other heat-fusing process in the thermoplastic walls 11 and 12 together along a narrow, straight line to form the closed top of the bag, as shown. The bottom edge 20 of the bag 10 remains open for filling.

Bags of the type disclosed in this application are used for heavy-duty applications, such as for transport and storage of materials such as salt, fertilizer, potting soil and the like. The bags are typically fabricated from a polyolefin sheet stock such as polyethylene having a thickness in the range of 3 to 12 mils. The sheet stock may be coextruded or monoextruded. The sheet stock may be single ply or multi-ply material. The multi-ply material may be multiple thicknesses of the same sheet stock, or different materials to provide particular characteristics, such as strength, flexibility, UV resistance, or color. The sheet stock may also be woven or non-woven synthetic or non-synthetic material.

A U-shaped slit 17 is die-cut into the area below seal 16 to form a carry handle when the hand is extended through the slit 17. The slit 17 is cut with corners which curve around in an arcuate shape on the opposing ends to prevent tearing from the top of the bag occurring. Another elongate seal 19 extends from the side edge 13 to the side edge 14 and defines the upper closure of the contents-holding portion of the bag 10. Preferably, the handle formed by the slit 17 remains tacked to the surrounding material by one or more small uncut tabs 17A until being broken when the handle is needed and the hand of the user is forced through the slit 17, breaking the tacked areas and freeing the slit 17 for use.

Figure 2:
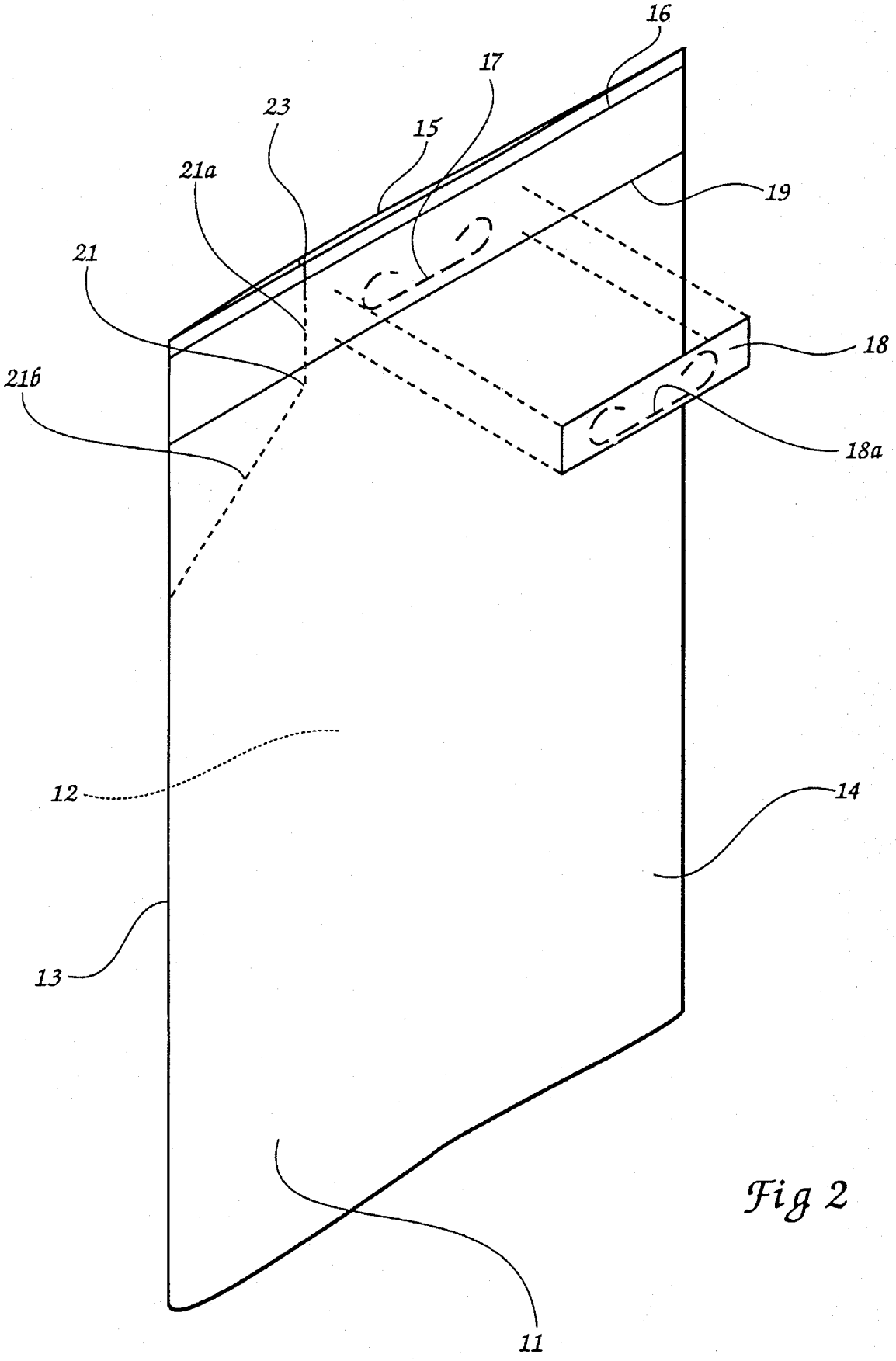
FIG. 2 is an exploded view of the bag shown in FIG. 1.

As is shown in FIG. 2, the handle area is reenforced by an additional patch 18 fabricated from a thermoplastic sheet stock. Patch 18 is adhered to the area overlaying and surrounding the slit 17 with a pressure sensitive adhesive. The patch is applied to the bag 10 before the handle slit 17 is die cut into the sheets 11 and 12. Therefore, a slit 18A in registration with slit 17 is formed in the patch 18 at the same time as the slit 17 is formed.

By way of example, one typical forty-pound capacity bag has a top seam 16 spaced ⅛ to ½ inch from the top edge 15, with the seam 19 spaced 2½ to 5 inches from the top edge 15. The slit 17 is formed between these two seams. Patch 18 may be 2 inches to 4½ inches wide and 4 to 10 inches long depending on the distance between seams 15 and 19, constructed of polyethylene sheet stock in tape roll form between 2 and 10 mils thick but with a preferred thickness of either 6 mils or 10 mils depending on customer requirements.

Preferably, the pressure sensitive adhesive is a solvent-based acrylic and is applied at a thickness of between 0.4 and 1.4 mils. The tape may be clear or colored to match or contrast with the color of the bag, as specified by the customer.

The patch 18 is formed by cutting to length a tape and applying the tape to the handle area of the bag between the seams 15 and 19 before forming the handle slits. For example, the patch, may be formed by use of a tape 6 inches wide, cut in 3 inch lengths, thus forming a patch 18 which is 3 inches wide and extends 6 inches along the width of the bag 10 side-to-side.

The patch 18 provides enhanced strength to the handle area of the bag 10. The pressure sensitive adhesive is of a type which permits the patch 18 to be removed by peeling it away from the bag 10 when desired, as described in further detail below.

Bag 10 includes a line of perforations 21, which extend laterally outwardly along the walls 11 and 12 to the side edge 13 just below the seal 22. The line of perforations 21 comprises two line segments: a line segment of perforations 21A which extends from immediately below the top end edge 15 perpendicular to the top end edge 15 and parallel to the first and second side edges 11 and 12, and a line segment of perforations 21B extending from the adjacent end of the line segment 21A to the closer side edge 13.

A notch 23 in both the walls 11 and 12 communicating with the top end edge 15 at the adjacent end of the line segment 21A forms a place to start the tear.

Figure 3:
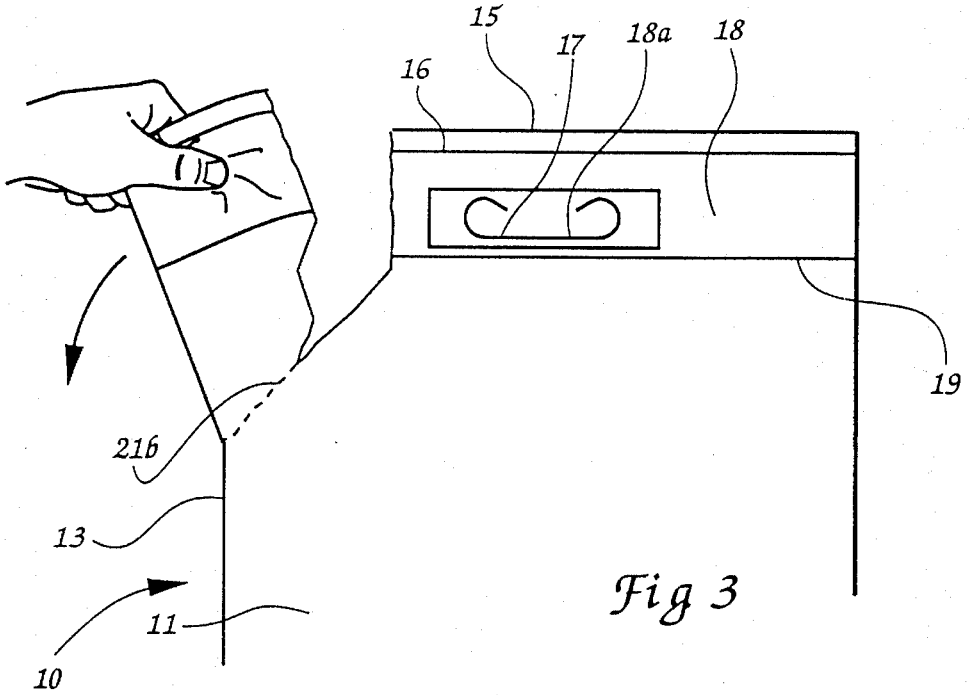
FIGS. 3, 4, 5 and 6 are sequential views of the manner in which the pour spout is formed and the reenforcing tape is removed from the handle and applied to the pour spout to close it.

As is shown in FIG. 3, the bag 10 is opened by gripping the bag near the notch 23 and enlarging the notch 23 by pulling the bag 10 on opposite sides of the notch 23 apart. The tearing motion extends the notch 23 into the line segment 21A, and the bridges between the perforations are ruptured by tearing. The tear extends down the line segment 21A and then diagonally down towards the side edge 13 along the line segment 21B. The corner segment is thus completely-severed from the bag 10. A pour spout opening 25 is formed in the corner of the bag 10 through which the contents can be poured.

Figure 4:
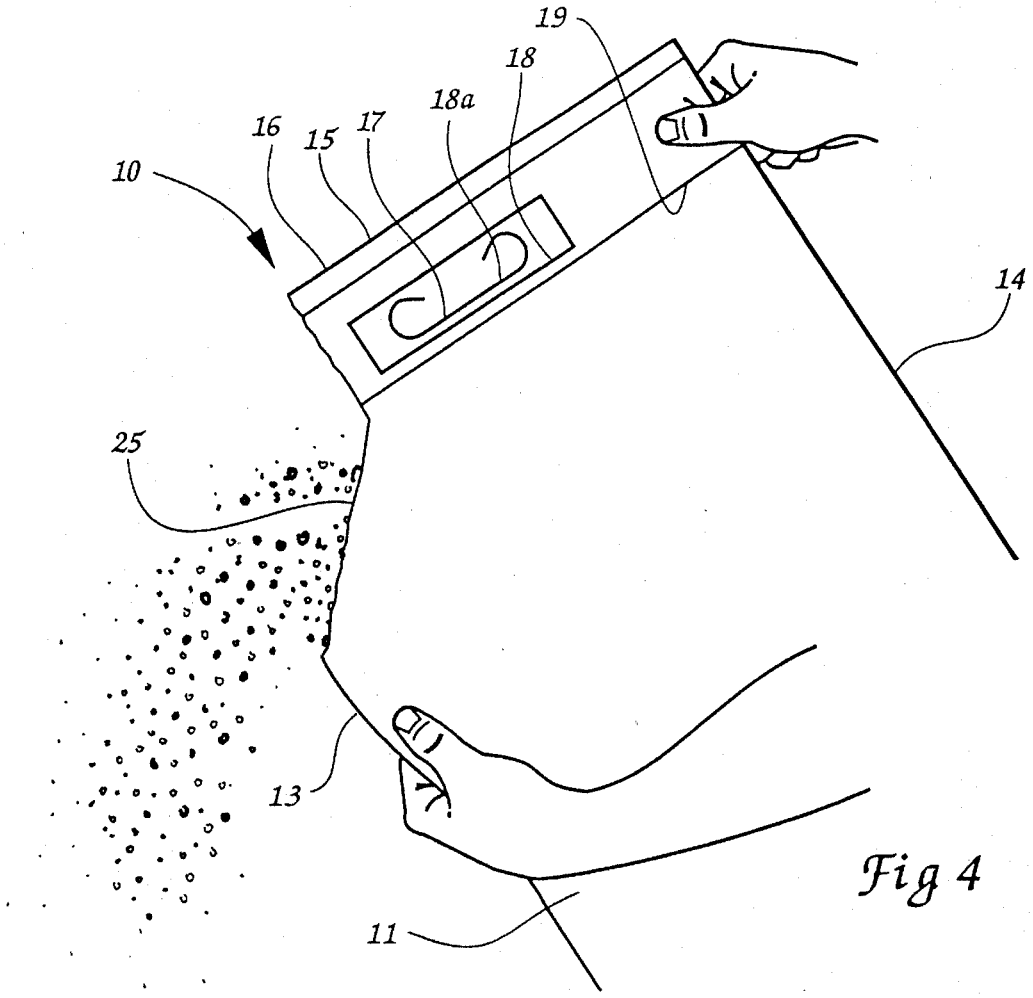

Material can be poured from the bag 10 with complete visibility and without diverting the flow of material, because the bag material severed to form the opening is completely removed and discarded. So much of the contents of the bag 10 as necessary are poured from the bag 10 through the pour spout opening 25, as is shown in FIG. 4.

Figure 5:
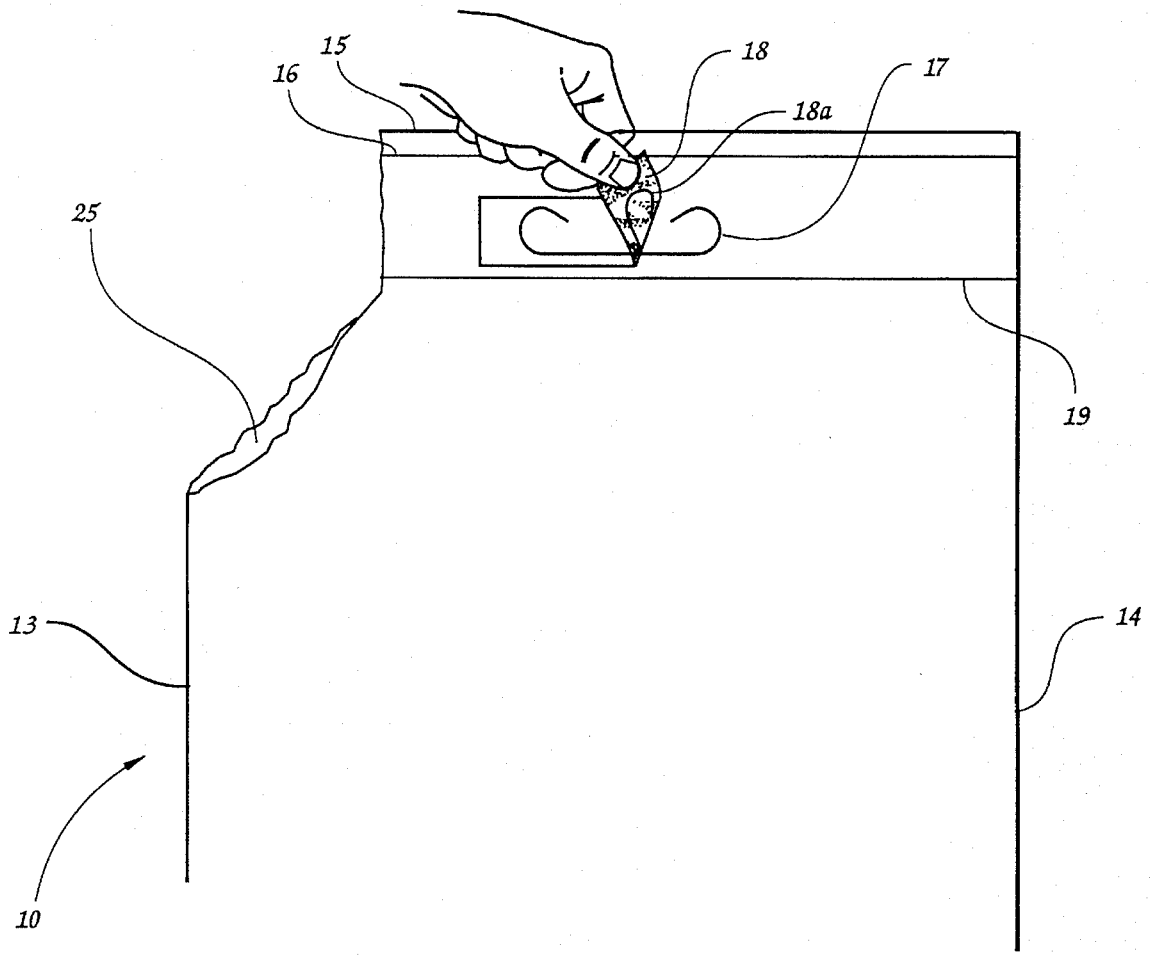

If there remain contents in the bag 10, the pour spout opening 25 may be sealed closed. As is shown in FIG. 5, the reenforcing patch 18 is peeled away from the wall 11 surrounding the handle slit 17. This does not interfere with the subsequent reuse of the handle. Since some of the contents of the bag 10 have already been poured out, the bag 10 contains less weight and the reenforcement previously provided by the patch 18 is not as necessary.

Figure 6:
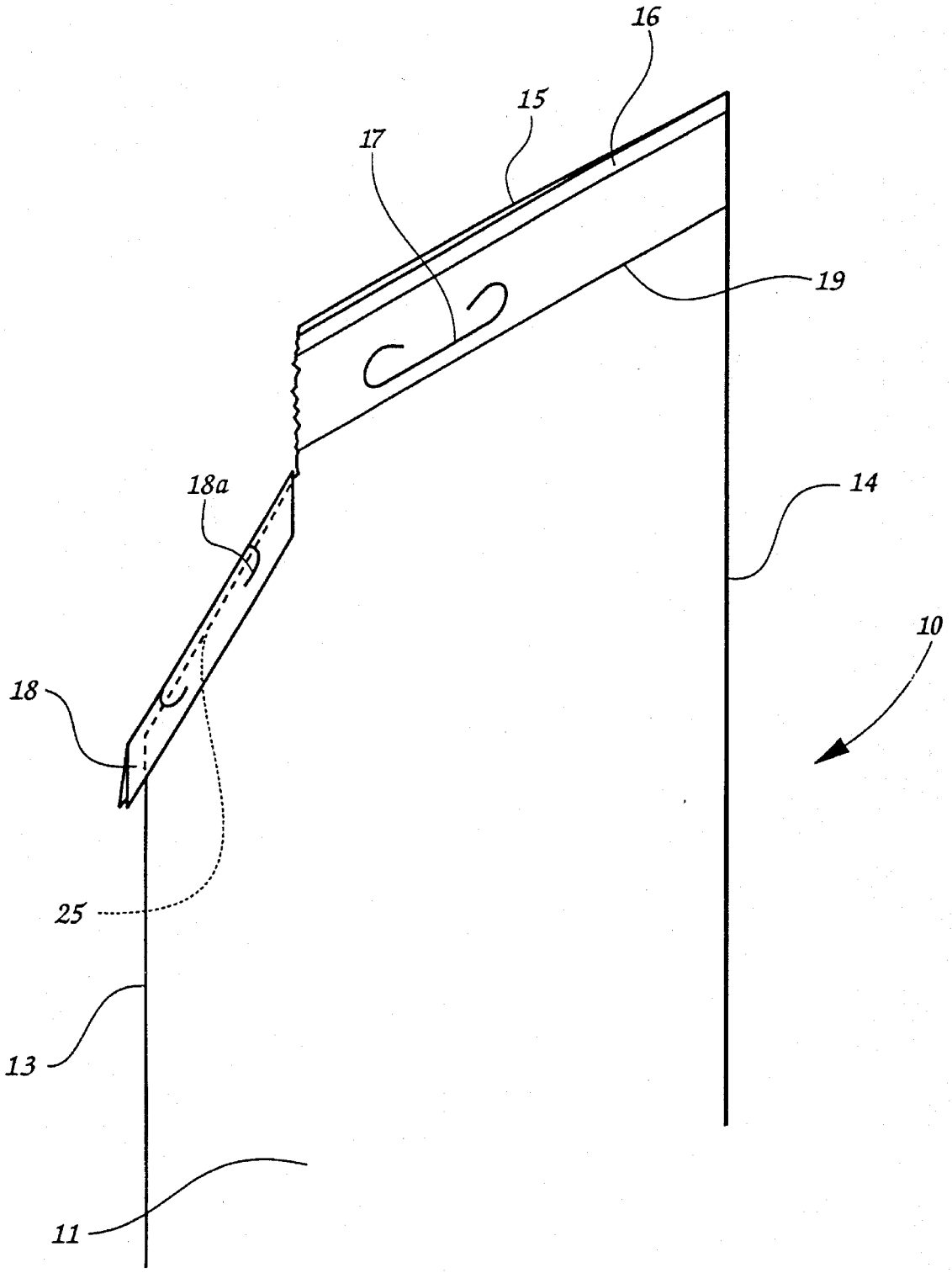

As is shown in FIG. 6, the patch 18 is applied across the opening of the pour spout. The adhesive on the inner surface of the patch 18 sticks to the walls 11 and 12 adjacent the pour spout opening 25 and to itself on the portions of the inner walls of the patch 18 which contact each other. This adherence effectively closes the slit 18A in the patch 18, thus preventing any of the contents of the bag 10 from leaking through the slit 18A.

When the bag 10 is to be reopened, the patch 18 can be peeled away from the pour spout opening 15 and reapplied as described above if it is necessary to reseal the bag 10 again. If the bag 10 is to be emptied, the patch 18 can be peeled or cut away and discarded.

Figure 7:
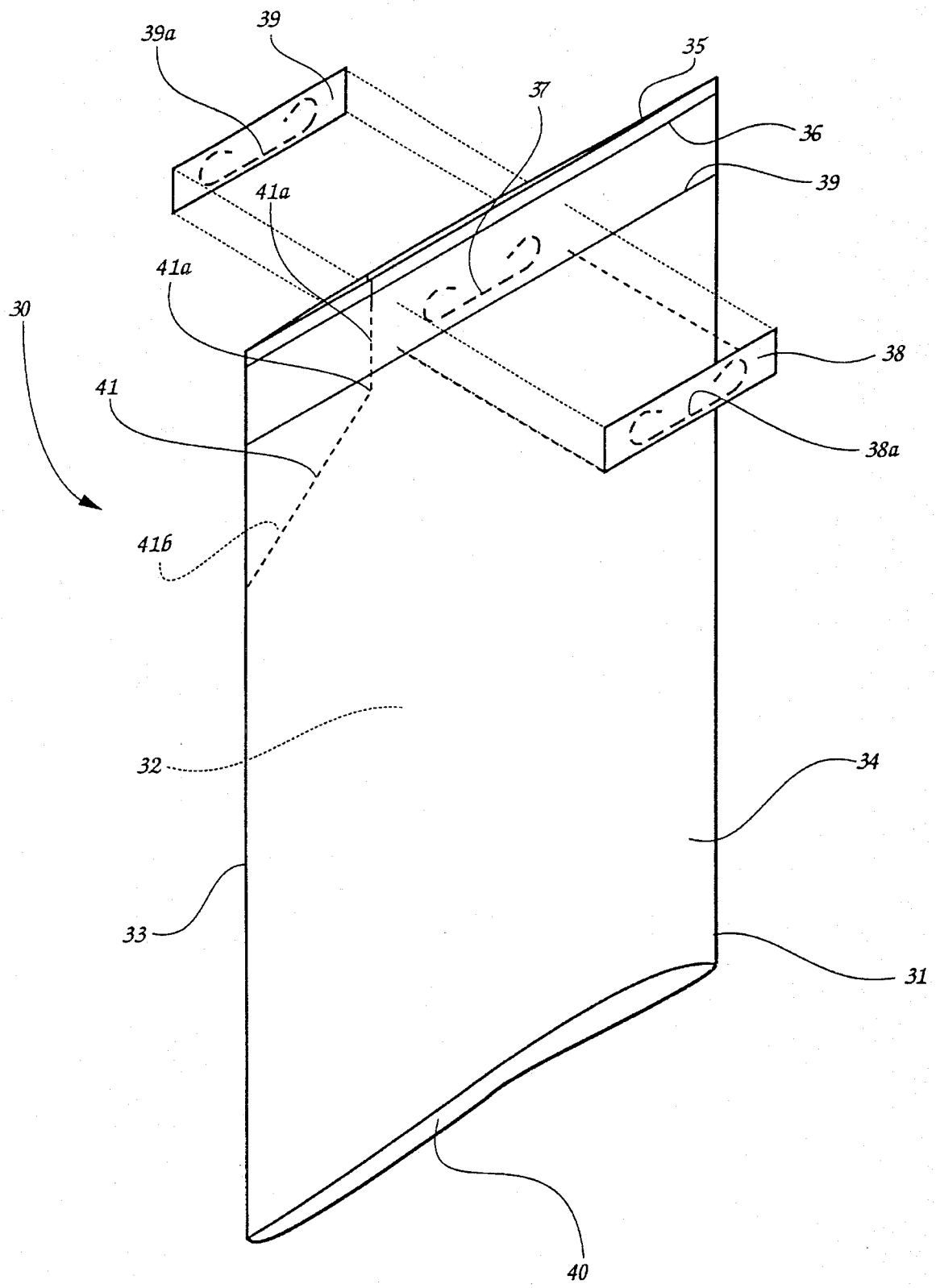
FIG. 7 is a perspective exploded view of another embodiment of the invention with separate reenforcing patches on both sides of the handle area of the bag.

As is shown in FIG. 7, a bag 30 according to another embodiment of the invention is formed from thermoplastic sheet stock, and has overlying walls 31 and 32, defining opposed, closed side edges 33 and 34. Bag 30 is formed in the manner described with reference to bag 10.

The top end edge 35 of the bag is closed by a seal 36 formed by adhesive, ultrasonic heating or other heat-fusing process in the thermoplastic walls 31 and 32 together along a narrow, straight line to form the closed top of the bag, as shown.

A U-shaped slit 37 is die-cut into the area below seal 36 to form a carry handle when the hand is extended through the slit 37. Another seal 39 extends laterally across the bag 30 from the side edge 33 to the side edge 34 and defines the upper closure of the contents-holding portion of the bag 30. Preferably, the handle formed by the slit 37 remains tacked to the surrounding material by one or more small uncut areas, until being broken when the handle is needed and the hand of the user is forced through the slit 37, breaking the tacked areas and freeing the slit 37 for use.

As is shown in FIG. 7, the handle area is reenforced by two patches 38 and 39 fabricated from a thermoplastic sheet stock. Patches 38 and 39 are adhered to the area overlaying and surrounding the slit 37 with a pressure sensitive adhesive, as described above. The patches 38 and 39 are applied to the bag 30 before the handle slit 37 is die cut into the sheets 31 and 32, as described above with reference to bag 10. Therefore, slits 38*a* and 39*a* in registration with slit 37 is formed in the respective patches 38 and 39 at the same time as the slit 37 is formed. The hand may therefore be extended through all three aligned slits to form a reenforced handle. The bottom edge 40 of the bag 30 remains open for filling.

Bag 30 includes a line of perforations 41, which extend laterally outwardly along the walls 31 and 32 to the side edge 33 just below the seal 42. The line of perforations 41 comprises two line segments: a line segment of perforations 41A which extends from immediately below the top end edge 35 perpendicular to the top end edge 35 and parallel to the first and second side edges 31 and 32, and a line segment of perforations 41B extending from the adjacent end of the line segment 41A to the closer side edge 33.

A notch 43 in both the walls 31 and 32 communicating with the top end edge 35 at the adjacent end of the line segment 41A forms a place to start the tear.

Because two patches 38 and 39 are used, one of the patches 38 or 39 can be removed and used to reseal the pour spout opening 45, while still leaving in place the other patch to provide reenforcement to the handle area after some of the contents have been poured from the bag 30.

A bag with a reenforced handle and a resealable pour spout opening is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. In a bag including first and second walls having joined first and second opposed side edges, an end edge, at least one seal line spaced from the end edge and extending laterally from one side edge to the other for sealing closed the end of the bag, a die cut opening defining a handle in the first and second walls adjacent to the end edge for receiving a hand therethrough, and a plurality of spaced-apart perforations formed in both of the first and second walls, the perforations defining a tear line for being torn in a progressively tearing motion to form an opening in the bag from which the contents of the bag can be poured, the improvement comprising handle reenforcement and resealing means, and comprising; a strip of sheet material secured by a pressure sensitive adhesive to at least one of the first or second walls of the bag and positioned in reenforcing relation to the die cut handle for providing reinforcement to the handle when the bag is being carried by the handle, said strip being removable from its reenforcing position on the handle and repositioned over the pour spout opening in the bag and secured in place by the pressure sensitive adhesive for sealing the opening in the bag to retain remaining contents therein.

2. In a bag according to claim 1, wherein said sheet material is formed of a sheet of thermoplastic material.

3. In a bag according to claim 2, wherein said thermoplastic material is selected from the group consisting of polyolefin, polypropylene and polystyrene.

4. In a bag according to claim 2, wherein said thermoplastic material comprises high strength polyethylene film.

5. In a bag according to claim 1, wherein said sheet material is secured to one wall of the bag.

6. In a bag according to claim 1, wherein the sheet material comprises first and second reenforcement strips secured to respective first and second walls of the bag.

7. In a bag according to claim 1, 2, 3, 4, 5, or 6, wherein the sheet material is die cut in registration with the die cut handle, and is positioned over and in surrounding relation to the die cut handle.

8. In a bag according to claim 1, wherein said bag includes two spaced-apart seal lines adjacent the end edge of the bag, said handle being positioned in an area between the two spaced-apart seal lines.

* * * * *